US009340351B2

(12) United States Patent
Conlon et al.

(10) Patent No.: US 9,340,351 B2
(45) Date of Patent: May 17, 2016

(54) PACKAGE FOR STACKED PRODUCT PIECES HAVING A PATTERN OF SEVERABLE LOCATIONS

(75) Inventors: Julie Conlon, Mount Arlington, NJ (US); Donald McArthur, Oswego, NY (US); Benjamin Davis, Columbia, SC (US)

(73) Assignees: Intercontinental Great Brands LLC, East Hanover, NJ (US); Sonoco Development, Inc., Hartsville, SC (US)

( * ) Notice: Subject to any disclaimer, the term of this patent is extended or adjusted under 35 U.S.C. 154(b) by 550 days.

(21) Appl. No.: 13/808,621

(22) PCT Filed: Jul. 7, 2011

(86) PCT No.: PCT/US2011/043149

§ 371 (c)(1),
(2), (4) Date: Mar. 11, 2013

(87) PCT Pub. No.: WO2012/006401

PCT Pub. Date: Jan. 12, 2012

(65) Prior Publication Data

US 2013/0206632 A1 Aug. 15, 2013

Related U.S. Application Data

(60) Provisional application No. 61/362,867, filed on Jul. 9, 2010.

(51) Int. Cl.

| | |
|---|---|
| ***B65D 5/54*** | (2006.01) |
| ***B65D 85/62*** | (2006.01) |
| ***B65D 75/58*** | (2006.01) |

(52) U.S. Cl.

CPC ..... *B65D 85/62* (2013.01); *B65D 75/585* (2013.01); *B65D 75/5844* (2013.01); *B65D 75/5888* (2013.01)

(58) Field of Classification Search

CPC ..... B65D 75/5844; B65D 75/5888; B65D 75/585; B65D 85/62

USPC ..... 206/499, 820; 229/101, 101.1, 101.2, 229/235, 264, 87.01, 87.05; 383/205, 207

See application file for complete search history.

(56) References Cited

U.S. PATENT DOCUMENTS 265,735 A 10/1882 Baxter
395,243 A * 12/1888 Maggi ..... 206/499

(Continued)

FOREIGN PATENT DOCUMENTS

| | | |
|---|---|---|
| CA | 2434074 | 7/2002 |
| CA | 2589719 | 6/2006 |

(Continued)

OTHER PUBLICATIONS

English Translation of French Patent Application No. 2496599A1.

(Continued)

*Primary Examiner* — Luan K Bui
(74) *Attorney, Agent, or Firm* — Hoffmann & Baron, LLP

(57) ABSTRACT

A package supports and dispenses one or more longitudinally stacked product pieces (18). The package includes a sheet positioned around the stacked product pieces. The sheet includes a plurality of longitudinally spaced weakened locations (120) extending transversely thereabout. The weakened locations include a pair of weakened extents (125) which are closely longitudinally spaced. Each weakened location defines a severable location for the sheet to permit dispensing of the product from the package.

15 Claims, 4 Drawing Sheets

(56) References Cited

U.S. PATENT DOCUMENTS

| | | | | | |
|---|---|---|---|---|---|
| 428,502 | A | | 5/1890 | Maggi | |
| 1,420,285 | A | | 6/1922 | Reinhold | |
| 1,550,966 | A | | 8/1925 | Kappes | |
| 1,560,681 | A | * | 11/1925 | Fisher | 229/101.1 |
| 1,578,066 | A | | 3/1926 | Bolingbroke | |
| 1,598,951 | A | | 9/1926 | Wright | |
| 1,751,755 | A | | 3/1930 | Paris | |
| 1,815,800 | A | | 7/1931 | Respess | |
| 1,932,169 | A | | 10/1933 | Allen et al. | |
| 2,078,227 | A | | 4/1937 | Blum | |
| 2,079,815 | A | | 5/1937 | Ringler | |
| 2,091,126 | A | | 8/1937 | Speer | |
| 2,128,843 | A | | 8/1938 | Mullins | |
| 2,145,430 | A | | 1/1939 | New | |
| 2,192,472 | A | | 3/1940 | Huston | |
| 2,205,437 | A | | 6/1940 | Ringler | |
| 2,263,835 | A | | 11/1941 | Atkinson | |
| 2,279,381 | A | * | 4/1942 | Richardson | 229/101.1 |
| 2,447,096 | A | * | 8/1948 | Schneider | 229/101.1 |
| 2,465,597 | A | | 3/1949 | Marsh | |
| 2,582,655 | A | | 1/1952 | Schenk | |
| 2,752,037 | A | | 6/1956 | Vogt | |
| 2,852,179 | A | | 9/1958 | Bieler | |
| 2,896,837 | A | | 7/1959 | Risucci | |
| 2,969,902 | A | | 1/1961 | Cage | |
| 3,086,692 | A | * | 4/1963 | Cage | 229/101.1 |
| 3,092,502 | A | | 6/1963 | Smith | |
| 3,132,028 | A | | 5/1964 | Austin et al. | |
| 3,236,369 | A | | 2/1966 | Moore | |
| 3,386,643 | A | | 6/1968 | Gentry | |
| 3,428,240 | A | | 2/1969 | Morris | |
| 3,472,368 | A | | 10/1969 | Hellstrom | |
| 3,539,093 | A | * | 11/1970 | Massengill | 229/101.1 |
| 3,967,773 | A | * | 7/1976 | Kaufmann | 229/101.1 |
| 4,091,929 | A | * | 5/1978 | Krane | 229/101.1 |
| 4,133,431 | A | | 1/1979 | Fischer | |
| 4,436,205 | A | | 3/1984 | Horii | |
| 4,546,875 | A | | 10/1985 | Zweber | |
| 4,549,653 | A | | 10/1985 | Lauritzen | |
| 4,589,575 | A | | 5/1986 | Rigberg et al. | |
| 4,658,963 | A | | 4/1987 | Jud | |
| 4,938,363 | A | * | 7/1990 | Amendola | B29C 59/007 229/87.05 |
| 5,029,712 | A | | 7/1991 | O'Brien et al. | |
| 5,215,249 | A | | 6/1993 | Gorrieri | |
| 5,470,016 | A | | 11/1995 | Ljungstrom et al. | |
| 5,632,378 | A | | 5/1997 | Provost | |
| 5,704,539 | A | | 1/1998 | Ljungstrom et al. | |
| 5,704,649 | A | | 1/1998 | Small | |
| 6,082,368 | A | | 7/2000 | Brown | |
| 6,142,366 | A | | 11/2000 | Sagel | |
| 6,168,075 | B1 | | 1/2001 | Sagel | |
| 6,394,320 | B1 | | 5/2002 | Feiman | |
| 6,572,904 | B2 | | 6/2003 | Rhee | |
| 6,799,715 | B1 | * | 10/2004 | Bennett et al. | 229/101.1 |
| 6,808,727 | B2 | | 10/2004 | Kemeny | |
| 7,302,786 | B2 | | 12/2007 | Oleandri et al. | |
| 2005/0069610 | A1 | | 3/2005 | Connolly et al. | |
| 2005/0178679 | A1 | | 8/2005 | Wojcik | |
| 2006/0185328 | A1 | | 8/2006 | Salicini et al. | |
| 2007/0224312 | A1 | | 9/2007 | Aldridge | |
| 2008/0017531 | A1 | * | 1/2008 | Tanbo | B65D 85/1072 206/264 |
| 2008/0118611 | A1 | | 5/2008 | Cellie et al. | |
| 2009/0266036 | A1 | | 10/2009 | Zerfas et al. | |

FOREIGN PATENT DOCUMENTS

| | | | |
|---|---|---|---|
| DE | 93 03 965 | U1 | 5/1993 |
| DE | 42 37 795 | A1 | 5/1994 |
| EP | 1224125 | A | 6/2004 |
| EP | 1 247 642 | B1 | 10/2005 |
| EP | 1 970 324 | A1 | 9/2008 |
| EP | 1 988 032 | A1 | 11/2008 |
| FR | 2 496 599 | A1 | 6/1982 |
| FR | 2 791 646 | A1 | 10/2000 |
| JP | HO872864 | A | 3/1996 |
| JP | 2000-79969 | A | 3/2000 |
| JP | 2003136638 | A | 5/2003 |
| JP | 2007-153383 | A | 6/2007 |
| MX | 9709407 | A | 3/1998 |
| WO | 94/21520 | A1 | 9/1994 |
| WO | 9623711 | A | 8/1996 |
| WO | 9935039 | A1 | 7/1999 |
| WO | 00/59801 | A1 | 10/2000 |
| WO | 02/094680 | A1 | 11/2002 |
| WO | 2004/110880 | A1 | 12/2004 |
| WO | 2004113061 | A1 | 12/2004 |
| WO | 2006/132761 | A1 | 12/2006 |
| WO | 2007/034332 | A2 | 3/2007 |
| WO | 2008046169 | A2 | 4/2008 |
| WO | 2008/051813 | A1 | 5/2008 |
| WO | 2009/034377 | A1 | 3/2009 |
| WO | 2009/100829 | A1 | 8/2009 |
| WO | 2010/038080 | A1 | 4/2010 |
| WO | 2010/070331 | A1 | 6/2010 |
| WO | 2010/075242 | A1 | 7/2010 |
| WO | 2012175507 | A1 | 12/2012 |

OTHER PUBLICATIONS

English Translation of German Utility Model No. G 93 03 965.4.
Third Party Observations, European Patent Office Application No. 11732547.2, 4 pages, Apr. 9, 2014.

* cited by examiner

PACKAGE FOR STACKED PRODUCT PIECES HAVING A PATTERN OF SEVERABLE LOCATIONS

CROSS REFERENCE TO RELATED APPLICATIONS

This application is the National Stage of International Application No. PCT/US2011/043149, which designates the U.S., filed Jul. 7, 2011, which claims the benefit of U.S. Provisional Patent Application No. 61/362,867 filed on Jul. 9, 2010, the contents of all of which are incorporated herein by reference in their entirety.

FIELD OF THE INVENTION

The present invention relates generally to a package for supporting and dispensing product pieces arranged in a stacked array. More particularly, the present invention relates to a sheet formed package for a longitudinally stacked array of one or more consumable product pieces which is severable along the length of the package to dispense individual product pieces.

BACKGROUND OF THE INVENTION

It is common to package and distribute various product pieces arranged in one or more vertically stacked arrays. In the confectionery industry, for example, candy pieces are often arranged in a longitudinally stacked array and are covered or wrapped in an outer wrapping forming an elongate stick-like package. Most often, the outer wrapper is formed of a foil or foil like material. While a paper or film wrapper may be placed over the foil, the foil is usually employed inasmuch as the foil can be opened and reclosed once one or more of the stacked candies are removed. Foil is known to have "dead fold" characteristics in that an extent of the foil which remains after removal of the candy can be folded down onto the opened end of the package to enclose the remaining candy pieces.

While the foil outer wrapper serves adequately to hold, dispense and reclose the candies arranged in a stacked array, the use of foil as an outer wrapper does have certain disadvantages. The "dead fold" characteristics of the foil require the user to retain the entire package even as the products are used, as it is difficult to remove excess packaging.

In certain situations, films may be used, as films may exhibit certain advantages over foil such as lower cost.

An improved package for stacked product pieces using a severable film is shown and described in International Publication No. WO 2010/075242 A1 having a publication date of Jul. 1, 2010 entitled "SEVERABLE FILM PACKAGE FOR STACKED PRODUCT PIECES", the disclosure of which is incorporated herein for all purposes.

Shown therein is a sheet of plastic or film wrap which forms a package for containing a plurality of stacked pieces. In order to allow for severing of the film package along the length thereof so as to dispense individual product pieces contained therein, the film package includes a plurality of longitudinally spaced apart weakened locations. The weakened locations preferably extend around the package are transverse to the longitudinal direction of the package and are spaced longitudinally along the package generally between adjacently stacked pieces. These weakened locations allow severing of the package thereat so as to individually dispense in succession the stacked pieces contained therein. The above-referenced international application describes several different shapes and embodiments for the weakened locations, each of which serves adequately for its intended purposes. However, further improvements in the particular pattern of the weakened locations would improve the dispensing of the product from the package.

It is, therefore, desirable to provide a sheet-like outer wrapper for stacked products which overcomes many of the disadvantages associated with the use of metallic foil and improves the severability thereof.

SUMMARY OF THE INVENTION

The present invention provides a package for supporting and dispensing one or more longitudinally stacked product pieces. The package comprises a sheet positioned about the stacked product pieces. In some embodiments, the package may have a generally cylindrical configuration. The sheet includes a plurality of longitudinally spaced weakened locations extending transversely to the longitudinal direction of the package. In some embodiments, the weakened locations may be generally parallel to each and perpendicular to a longitudinal axis of the package. Each of the weakened locations may include a pair of weakened extents which are closely longitudinally spaced and perpendicular to the longitudinal axis. The weakened extents for each weakened location may be in parallel with each other or each may have an axis or portions that are generally parallel with each other. Each weakened location defines a severable location for the sheet. The distance between the pair of weakened extents for a single weakened location may be greater than the distance between adjacent weakened locations or the centerlines of the adjacent weakened locations.

The package may also include weakened extents which are discontinuous about the sheet.

Where the weakened extents are discontinuous, the discontinuity of one of the weakened extents of the pair is offset from the discontinuity of the weakened extent of the other of the pair.

The weakened locations may be formed by spaced apart cuts placed in the sheet.

Cuts placed in the sheet of each weakened location may be formed to have the same depth.

Alternatively, the cuts in the weakened location may be formed to have different depths.

The cuts may be formed to be of uniform length and the spaces between the cuts may also be uniform.

The weakened location may include a combination of both a single weakened extent and a pair of weakened extents.

DETAILED DESCRIPTION OF PREFERRED EMBODIMENTS

Figure 1:
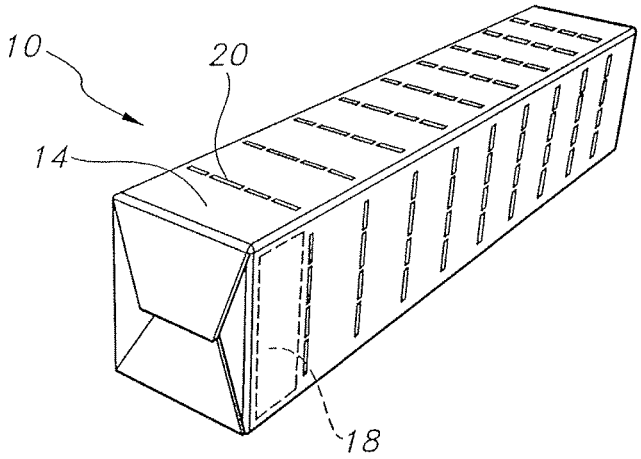
FIG. 1 PRIOR ART
FIG. 1 is a perspective view of a prior art package which may be used in combination with the present invention.

The present invention provides a package for supporting a plurality of consumable or other product pieces which are arranged in a longitudinally stacked array. One type of package is shown in FIG. 1. The package of FIG. 1 is more fully described in the above-incorporated international application.

Package 10 shown in FIG. 1 encloses a plurality of longitudinally adjacently stacked consumable product pieces 18. The package 10 is configured from a sheet 14, which covers the plurality of pieces 18 in order to support and retain the consumable pieces in the longitudinally stacked array.

One type of material used to form the sheet 14 of FIG. 1 is a plastic film. It is known, for example, that plastic film used to form sheet 14 is generally not readily rupturable. Thus, in order to allow the user to efficiently and effectively remove one or more pieces 18 from the package 10 and also to allow removal of the waste packaging along with the pieces, a plurality of longitudinally spaced weakened locations 20 is placed in the film. The weakened locations are longitudinally spaced along the length of the package 10, preferably between adjacent product pieces 18.

As described in the above-referenced international application, the weakened locations allow a user to apply pressure thereto by exerting a twisting or angled force to the package in order to remove a portion of the package at the weakened location. With the removed portion, one or more pieces may be separated from the package. This facilitates easy removal of one or more pieces from the package while at the same time reducing the size of the remaining package and any dead packaging or waste paper associated with the use of the package.

One or more consumable pieces may be dispensed at a single time. The user can adjust the grip with respect to the package so as to dispense the desired number of pieces.

As will be described hereinbelow, the present invention provides improvements in the weakened locations of the package similar to the type shown in FIG. 1 to more easily dispense product from the package. The package described hereinbelow is formed from an elongate sheet having a pattern of weakened locations placed thereon. The weakened locations are positioned to be longitudinally spaced along the package when the sheet is formed around the product pieces. Preferably, the weakened locations are positioned between adjacent product pieces. The package sheet may be formed from various materials including flexible materials. Such materials may include flexible films, foils, paper or combinations thereof as well as multiple layers of the same or different materials. Laminate materials may also be employed. One such laminate material combination may include paper/poly/foil.

One material combination for the sheet may include a foil layer that is backed on one side by a poly/paper/poly laminate. On the opposite side of the foil, a lacquer coating may be applied as a base for ink, used to create package graphics. The ink may include a heat seal layer, forming the outside surface of the sheet. The heat seal layer is used to seal the outside surface to the inside surface in creating the wrapper on the package. It is contemplated that the cuts are provided inside of the foil layer, within the poly/paper/poly laminate.

Typically, multiple sheets are cut from an elongate expanse where the weakened locations are formed as spaced apart double parallel lines along the expanse. The lines may be formed by cuts or the like placed on either or both sides of the sheet. The cuts may be provided therein, for example, as die cut perforations or laser scores.

A package having such weakened locations in accordance with the present invention is described as follows:

Double Dash

Figure 2:
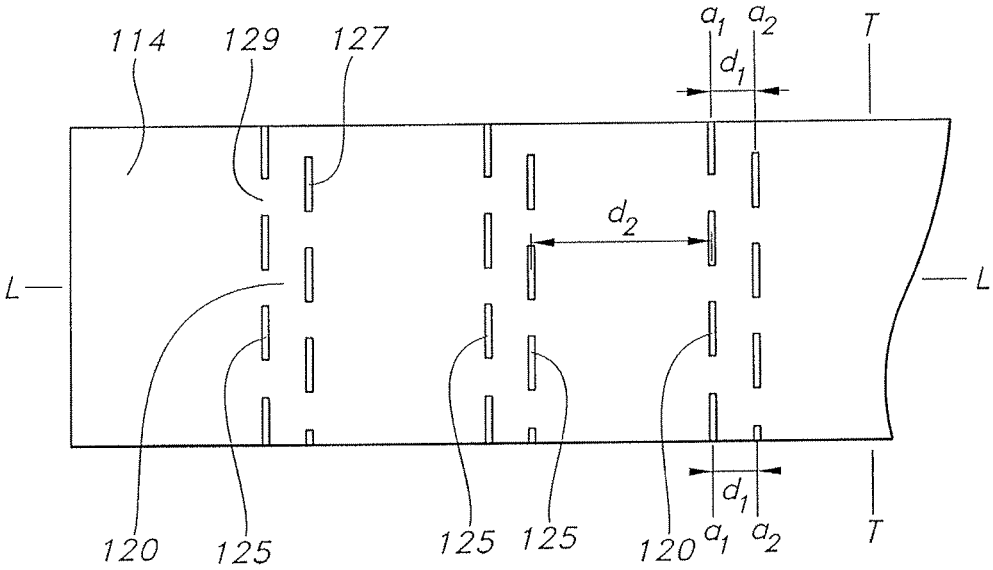
FIG. 2 is a schematic drawing showing a portion of the package of the present invention.
Figure 3:
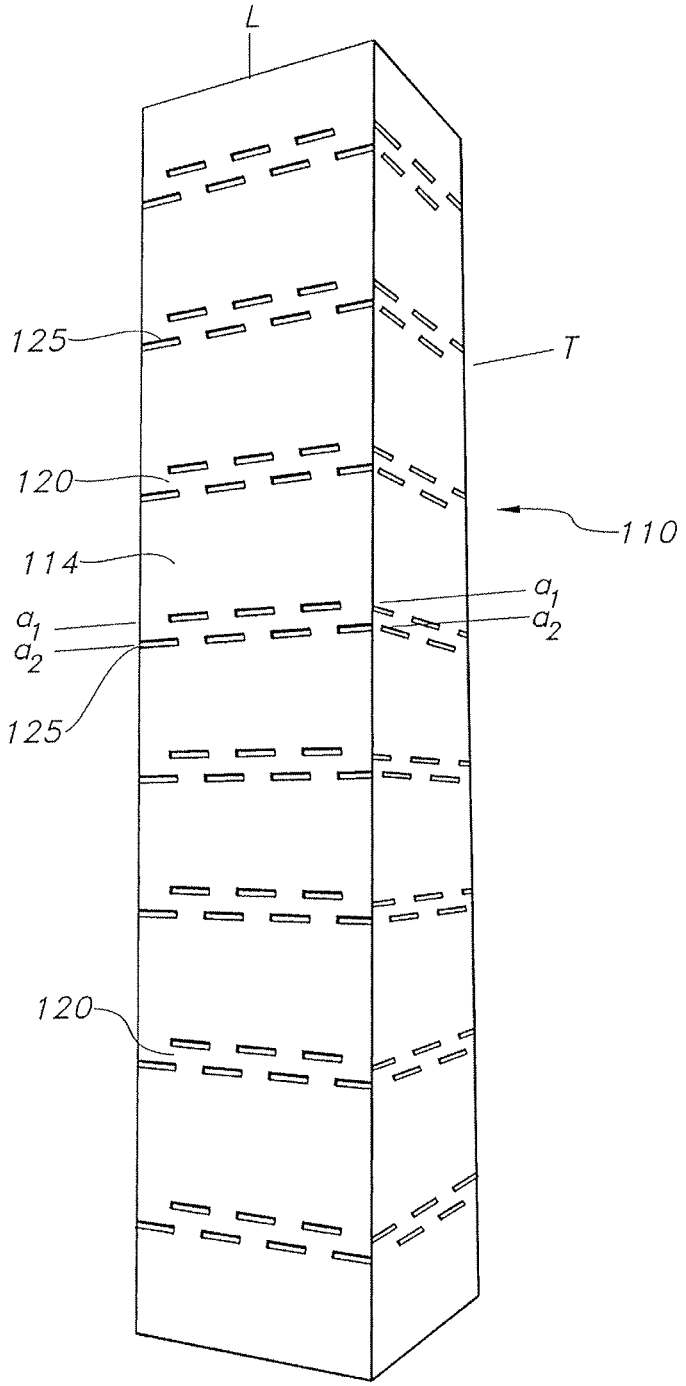
FIG. 3 is a perspective showing of a package of the present invention.

One embodiment of the improved spaced apart double parallel lines used to form the weakened locations is shown in FIGS. 2 and 3. A sheet 114 is used to form an elongate package 110. The package 110 extends along a line L. The package includes a plurality of longitudinally spaced double parallel lines or extents 125 forming the weakened locations 120. The weakened locations 120 extend transversely about the package 110 along the direction of line T, preferably perpendicular to line L. In this embodiment, closely spaced lines or extents 125 forming each weakened location 120 include a pattern of double dash weakened extents where each dash is a discontinuous series of cuts 127 and spaces 129 formed therealong.

Each weakened extent 125 of the weakened location 120 extends along an axis where the axes $a_1$ and $a_2$, the lines defined by the cuts and spaces, are generally parallel. The spacing between the extents 125 of each weakened location is preferably significantly closer than the spacing between adjacent weakened locations 120. The spacing between each weakened location preferably corresponds to the spaces between each product piece. Thus, the distance $d_1$ between $a_1$ and $a_2$ is less than the distance $d_2$ between adjacent weakened locations.

In one presently preferred embodiment, the pattern of cuts and spaces may be arranged so that the cut of one line of the double dash is aligned with the space of the other line of the double dash. Thus, the pattern of cuts and spaces between the closely spaced parallel lines are staggered. While this is one preferred embodiment of the double dash lines, it may be appreciated that the arrangement of cuts and spaces may be such that the cuts and spaces are mutually aligned with respect to the parallel lines.

Additionally, in one preferred embodiment, the cuts are generally of uniform length and the spacing between the cuts is also uniform. The elongate cuts and spaces may be preferably formed in a co-linear orientation arranged along the respective axes $a_1$ and $a_2$. Thus, the length of the cuts are preferably aligned along the axes $a_1$ and $a_2$.

Furthermore, it is contemplated that the depth of the cuts may be uniform with respect to each of the longitudinally spaced weakened locations. It is contemplated that with uniform depth, the twisting force required to sever the package and remove the product pieces would be the same at any location along the length of the package.

Figure 5:
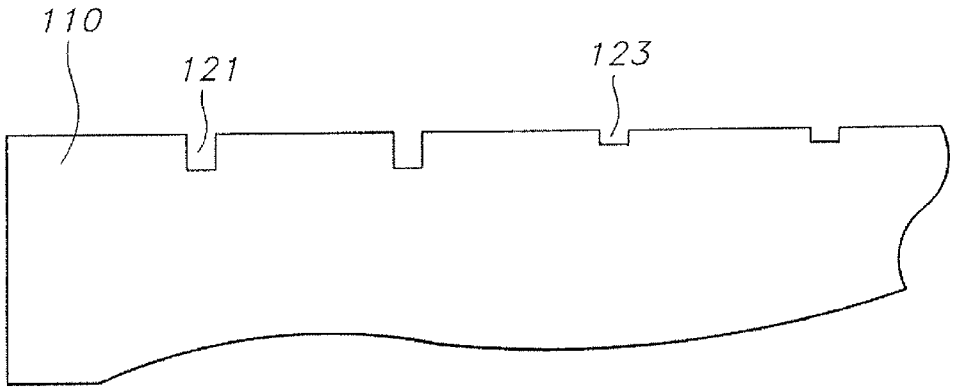
FIG. 5 is a schematic representation of the depths of the cuts of the present invention.

It is further contemplated, however, that the depths of the cuts for the weakened locations may be different along the longitudinal expanse of the package. For example FIG. 5, one technique contemplates placing shallower depth cuts 123 for the weakened locations at the center of the package while including deeper cuts 121 for the weakened locations at the longitudinal ends. Since the package is severed by a twisting force applied by the user, the shallower cuts at the center would help resist inadvertent severing of the package at a center location when the user is desirous of removing product at the end of the package. In this manner, having deeper cuts at the end of the package, the ends would sever more easily thereby dispensing the product at the end of the package.

Single/Double Dash

It is still further contemplated that in one preferred embodiment, the spaced apart double parallel lines used to form the weakened locations may be used at the ends of the package while a single parallel line may be employed at locations in the center of the package.

Figure 4:
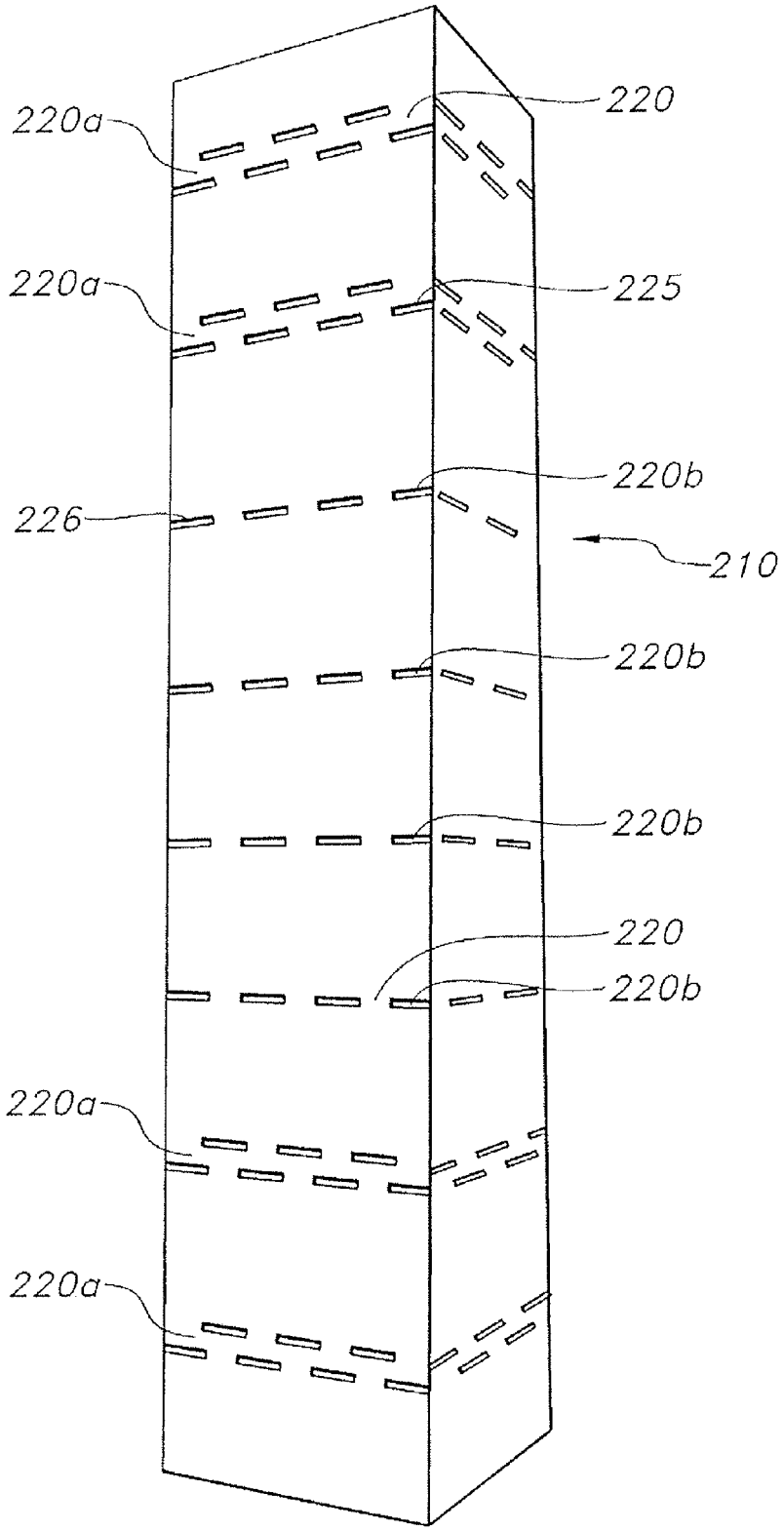
FIG. 4 is a perspective showing of a further embodiment of the present invention.

Referring now to FIG. 4, a package 210 is shown. Package 210 is substantially similar to package 110 described above with respect to FIGS. 2 and 3. Package 210 includes a plurality of weakened locations 220 spaced apart along the length of the package in a manner described above. Two weakened locations 220*a* adjacent each longitudinal end of package 210 are formed of longitudinally spaced double parallel lines or extents 225. The weakened locations 220*b* spaced along the center portion of package 210 are formed by a single line 226. The single line 226 shown in this embodiment may be similar to that shown and described with respect to FIG. 1 described above. The particular arrangement shown herein having single lines 226 at the center would also help resist inadvertent severing of the package at a center location when the user is desirous of removing product at the end of the package. In this manner, having double parallel lines or extents at the ends of package would result in the ends being more easily severed to dispense the product thereat.

The package of the present invention therefore provides ease of severing of the package at multiple locations therealong to dispense the pieces either sequentially or in groups.

Various changes to the foregoing described and shown structures would now be evident to those skilled in the art. Accordingly, the particularly disclosed scope of the invention is set forth in the following claims.

What is claimed is:

1. A package for supporting and dispensing one or more longitudinally stacked product pieces comprising:

a sheet positionable about said stacked product pieces;

said sheet including a plurality of longitudinally spaced weakened locations extending transversely thereabout;

each weakened location defining a severable location for said sheet;

wherein said weakened locations adjacent each longitudinal end of said package are more easily severable than the weakened locations at the center of the package;

said weakened locations are formed by cuts placed in said sheet;

said cuts of the weakened locations adjacent said ends are deeper than the cuts at said central portion.

2. A package of claim 1 wherein the weakened locations extend generally transversely about said package and have a given longitudinal spacing between adjacent weakened locations.

3. A package of claim 2 wherein said longitudinal spacing between said weakened extents of each weakened location of said pair is less than said given spacing between said adjacent weakened locations.

4. A package of claim 1 wherein said weakened locations at said ends include a pair of weakened extents.

5. A package of claim 4 wherein said weakened locations at said center include a single weakened extent.

6. A package of claim 4 wherein said pair of weakened extents are longitudinally spaced.

7. A package for supporting and dispensing one or more longitudinally stacked product pieces comprising:

an elongate sheet positionable about said stacked product pieces;

said sheet including a plurality of longitudinally spaced weakened locations extending transversely thereabout;

one or more weakened locations adjacent each end of said elongate sheet including a pair of weakened extents which are closely spaced to define a severable location; and one or more weakened locations at a central portion of said sheet including a single weakened extent to define a severable location;

said weakened locations adjacent said ends of said sheet being more easily severable than the weakened locations at the central portion of said sheet.

8. A package of claim 7 wherein said weakened extents are discontinuous about said sheet.

9. A package of claim 8 wherein said discontinuity of one weakened extent of said pair is offset from the discontinuity of the weakened extent of the other of said pair.

10. A package of claim 7 wherein weakened locations are formed by spaced apart cuts placed in said sheet.

11. A package of claim 10 wherein at least two of said cuts of each of the weakened locations are formed to the same depth.

12. A package of claim 10 wherein at least two of said cuts of each of said weakened locations are formed to different depths.

13. A package of claim 7 wherein said longitudinal spacing between each of said weakened extents of each said pair is the same.

14. A package of claim 10 wherein said cuts are uniformly spaced apart along the weakened extents.

15. A package of claim 10 wherein said cuts are of uniform length.

* * * * *